US006443863B1

(12) United States Patent
Dinoffer

(10) Patent No.: US 6,443,863 B1
(45) Date of Patent: Sep. 3, 2002

(54) BALL HAVING UNPREDICTABLE BOUNCE

(76) Inventor: Joe Dinoffer, 5416 Gurley Ave., Dallas, TX (US) 75223

( * ) Notice: Subject to any disclaimer, the term of this patent is extended or adjusted under 35 U.S.C. 154(b) by 0 days.

(21) Appl. No.: 09/691,900

(22) Filed: Oct. 19, 2000

Related U.S. Application Data

(60) Provisional application No. 60/160,455, filed on Oct. 21, 1999.

(51) Int. Cl.[7] ..... A63B 43/00
(52) U.S. Cl. ..... 473/595
(58) Field of Search ..... 473/595, 596, 473/597, 613, 614; 601/110, 113, 19, 120, 129; D21/707

(56) References Cited

U.S. PATENT DOCUMENTS

| | | | | | |
|---|---|---|---|---|---|
| 563,170 | A | * | 6/1896 | Haley | 473/595 |
| 744,718 | A | * | 11/1903 | Cassidy | 473/614 |
| 2,031,240 | A | * | 2/1936 | Van Deest | 473/595 |
| 2,078,382 | A | * | 4/1937 | Hanshaw | 473/595 |
| 2,362,064 | A | * | 11/1944 | Giesinger | 473/595 |
| 4,309,038 | A | * | 1/1982 | Spoon | 473/596 |
| D317,805 | S | * | 6/1991 | Swan | D21/707 |
| 5,028,053 | A | * | 7/1991 | Leopold | 473/473 |
| D358,858 | S | * | 5/1995 | McGreevy | D21/707 |
| D438,269 | S | * | 2/2001 | Brandon | D21/707 |

FOREIGN PATENT DOCUMENTS

| | | | | |
|---|---|---|---|---|
| FR | 1184170 | * | 2/1959 | 473/FOR 167 |
| FR | 2585255 | * | 1/1987 | 473/FOR 167 |
| GB | 1405454 | * | 10/1975 | 473/FOR 167 |
| SU | 1674881 | * | 9/1991 | 473/FOR 167 |

* cited by examiner

*Primary Examiner*—Steven Wong

(57) ABSTRACT

The invention pertains to a sports training ball designed to develop reaction and reflex skills, while keeping interest and enthusiasm high among the participants due to the unpredictable bounces the seven-knob rubber ball creates. It is well suited for training in many sports including baseball and is effective to help young athletes develop their visual tracking skills, reaction skills, and catching skills. Its unique seven-knob design ensures a different bounce every time it bounces against a flat surface. The seven-knob design includes two identical knobs of a larger size and five identical knobs of a smaller size and the ball is approximately the same mass as a tennis ball and a baseball. In short, it is challenging, but allows children of varying ages and skill levels to achieve success while building their skills.

4 Claims, 2 Drawing Sheets

Figure 1:
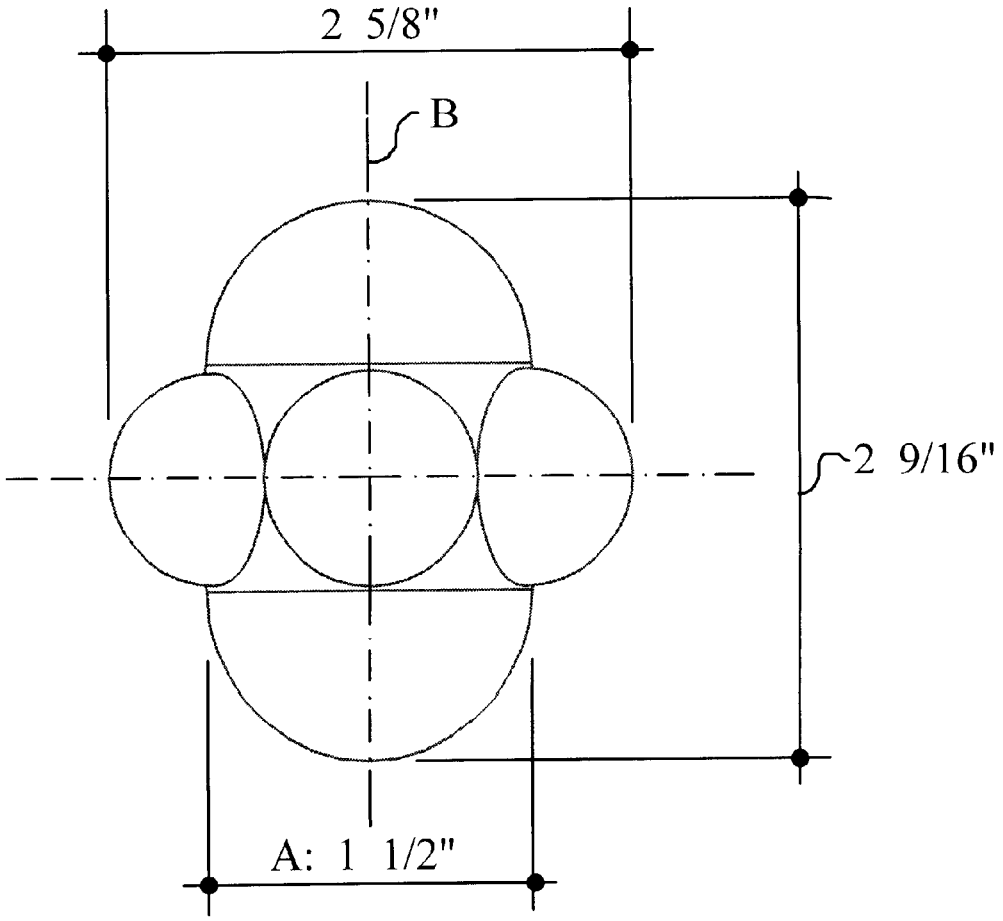
Figure 2:
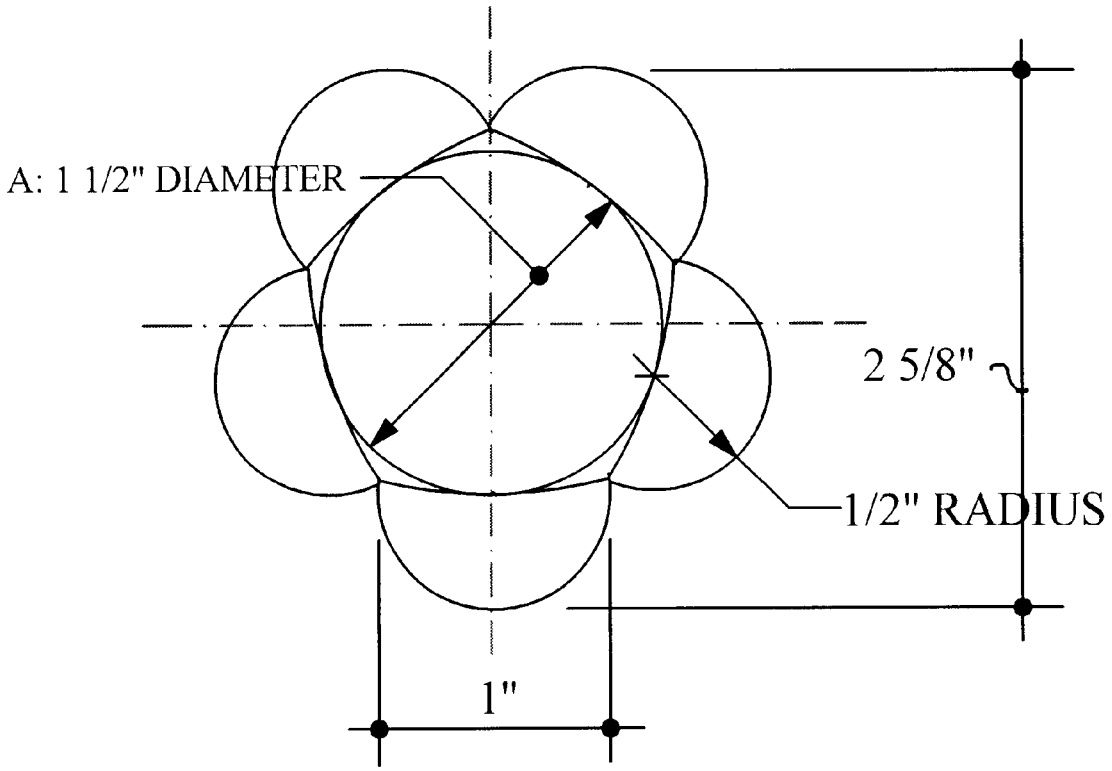

FRONT VIEW
FULL SIZE

A: CIRCUMFERENCE WHERE FIVE SMALLER KNOBS ARE LOCATED.
B: VERTICAL AXIS RUNNING PERPENDICULAR TO CIRCUMFERENCE A, WITH TWO LARGER KNOBS POSITIONED ON EACH END.

FRONT VIEW
FULL SIZE

A: CIRCUMFERENCE WHERE FIVE SMALLER KNOBS ARE LOCATED.
B: VERTICAL AXIS RUNNING PERPENDICULAR TO CIRCUMFERENCE A, WITH TWO LARGER KNOBS POSITIONED ON EACH END.

TOP VIEW
FULL SIZE

BALL HAVING UNPREDICTABLE BOUNCE

This application claims benefit to Provisional Application No. 60/160,455 filed Oct. 21, 1999.

1. BACKGROUND OF THE INVENTION

I have an extensive background in working with children, physical education teachers, and coaches of various sports (have authored 11 books). Through my research and experience I have found two balls with varying degrees of unpredictable bounces.

The first one (U.S. Pat. No. 5,028,053—Leopold, Jul. 2, 1991) is not suitable for sports training as the bounce is not challenging enough for young athletes. It is more of a toy for young children, rather than a skill building training tool. It consists of 22 small knobs that are evenly spaced on the outside of a small ball. The owners of the patent describe it as "A ball capable of providing an erratic, as well as a normal, bounce comprised of a hollow spherical member and, preferably, twenty-two integral hemispheric projections." They go on to state that "Based on the geometric design, approximately twenty-five percent of the bounces will be erratic." In other words, 75% of the bounces are normal and predictable. The result; not enough challenge.

On the other extreme, there is a ball with six equally sized and spaced knobs (Design U.S. Pat. No. D317,805—Swan, Jun. 25, 1991). It offers a consistently irregular bounce. However, when tested in use with a broad range of children in many sport environments, we have found it to be too challenging and therefore frustrating for all but the most elite athletes. Our observations with this ball show that approximately 25% of the bounces were impossible to catch, as the bounce was not too extreme, due to the size and placement of the knobs.

Although these two balls were not ideal in a broad range of activities for developing young athletes, we were still convinced that the idea of an unpredictable bouncing rubber ball would be very useful in sports training and lead-up reaction building games for children. The design of the ball for which this patent is being applied has the following unique characteristics.

1. It is of a larger size (35% larger than the ball in use under U.S. Pat. No. D317,805). One result of this larger size is that the ball contains more rubber mass and bounces noticeably higher, allowing the young athletes more time to react and catch it. This increase in reaction time is significant in helping children develop their skills and self-confidence in sports and physical activities.
2. It has seven knobs of two different sizes which create much more irregularity than U.S. Pat. No. 5,028,053, but significantly less irregularity than U.S. Pat. No. D317,805, since two of the knobs are approximately 50% larger in size than the other five knobs. The result is an unpredictable bounce that is still controlled enough to be encouraging to young athletes while they develop visual tracking skills, reaction skills, and catching skills.

Statistically speaking, a recent USA Today poll stated that 40% of all adults in the United States have negative memories of their experiences in physical education classes in schools and in team sporting activities in general when they were growing up. Studies also repeatedly show that confidence and self-esteem are directly linked to fun and enjoyment. And, we all know that confidence and self-esteem develop most quickly in children when they are successful.

At the same time, activities must be slightly challenging to keep children interested. Therefore, the subject of this patent is relevant and practical for skill development standpoint as well as to help children enhance the enjoyment of their experiences in physical education and sports in general.

2. BRIEF SUMMARY OF THE INVENTION

The invention is a skill building reaction ball used for sports training including, but not limited to, baseball and general reaction-building activities. Its unique 7-knob design ensures a different bounce every time it bounces against a flat surface. The 7-knob design includes two identical knobs of a larger size and five identical knobs of a smaller size. The result of this combination of knobs is a bounce that challenges young athletes but allows the ball to be caught, even by younger children. The manufacturing process is injection molding and the primary ingredient is rubber. Additionally, it is approximately the size of a tennis ball and a baseball, resulting in an easy transfer of acquired skills to those specific activities.

3. BRIEF DESCRIPTION OF THE DRAWINGS

Drawing #1: Depicts the invention from a side view perspective, along the referred to circumference of the ball, around which the five smaller knobs are placed side-by-side.

Drawing #2: Depicts the invention from a top view perspective, looking down on the axis of the ball, straight onto one of the two larger knobs.

4. DETAILED DESCRIPTION

The invention pertains to a sports training ball designed to help children develop their reaction and reflex skills for all sports and physical activities. At the same time, the ball is designed to keep interest and enthusiasm high among the participants due to the unpredictable bounces created by the seven-knobs molded into the rubber ball. It is well suited for training in many sports including baseball and is effective to help young athletes develop their visual tracking skills, reaction skills, and catching skills. Its unique seven-knob design ensures a different bounce every time it bounces against a flat surface.

The seven-knob design includes two identical knobs of a larger size and five identical knobs of a smaller size. The ball is approximately the same mass and size as a tennis ball and a baseball, which results in a relatively easy transfer of skills and exercises between many activities. In short, it is challenging, but allows children of varying ages and skill levels to achieve success while building their skills.

The ball is manufactured through an injection molding process and the primary ingredient in the ball is rubber. The materials used are non-toxic and are even safe if a pet happens to chew on it. The central sphere upon which the outer seven knobs sit is 1.5" in diameter. There are seven knobs that are semi-spherical in shape. They are molded onto the outside of the central sphere in two different sizes. One size consists of five knobs, and the second size consists of two knobs. The five identical semi-spherical knobs are 1" in diameter and are spaced equally side-by-side around one circumference of the inner sphere of the ball. For the purpose of this description, we will refer to this circumference as on a horizontal plane.

The two other knobs are also identical to one another. They are positioned on each end of what we shall refer to as the vertical axis of the ball, which runs perpendicular to the horizontal circumference listed above. These two identical knobs are 50% larger than the other five smaller knobs and have a diameter of 1½". They are also semi-spherical in shape.

The overall diameter of the ball is 2⅞" along the horizontal circumference. The overall diameter of the ball is 2⁹⁄₁₆" along the vertical axis.

It should be noted that in the manufacturing process the rubber expands when cooling to a small extent. The result is a small variance between the inside dimensions of the mold and the outside dimensions of the ball itself.

All of the seven knobs are adjacent to one another so that when bounced the inner sphere of the ball will not touch the surface struck. The result is an unpredictable yet "catchable" bounce, because of the combination of larger and smaller knobs, the size and placement of the knobs, and the size of the ball.

What is claimed is:

1. A rubber ball comprising an inner sphere having a diameter of 1.5 inches and seven semi-spherical knobs attached thereto, five of the knobs being of a first size and equally spaced side-by-side around a circumference of the inner sphere and two of the knobs being of a second size and positioned on a vertical axes of the ball running perpendicular to said circumference wherein the ball bounces unpredictably due to the semi-spherical knobs.

2. The rubber ball of claim 1 wherein the ball is made by an injection molding process and includes a non-toxic coloring agent.

3. The rubber ball of claim 1 wherein the five smaller knobs are identical and have diameters of one inch and protrude from the inner sphere ⁹⁄₁₆ inch.

4. The rubber ball of claim 1 wherein the two larger knobs are identical and have diameters of 1.5 inches and protrude from the inner sphere ¹⁷⁄₃₂ inch.

* * * * *